US005727785A

United States Patent [19]

Gennari et al.

[11] Patent Number: 5,727,785

[45] Date of Patent: Mar. 17, 1998

[54] APPARATUS FOR LOADING ENVELOPES ONTO SORTING MACHINES

[75] Inventors: Nedo Gennari; Andrea Faure, both of Genoa, Italy

[73] Assignee: Finmeccanica S.p.A., Rome, Italy

[21] Appl. No.: 653,445

[22] Filed: May 24, 1996

[30] Foreign Application Priority Data

Jul. 4, 1995 [IT] Italy ..... MI95A1428

[51] Int. Cl.[6] ..... B65H 5/16

[52] U.S. Cl. ..... 271/271; 271/198; 198/732

[58] Field of Search ..... 271/269, 271, 271/198, 84, 184, 189, 215; 198/732, 740, 359, 360

[56] References Cited

U.S. PATENT DOCUMENTS

| | | | |
|---|---|---|---|
| 3,972,415 | 8/1976 | Rohde | 198/359 |
| 4,682,684 | 7/1987 | Lothmar | 198/732 |
| 5,184,711 | 2/1993 | Zambelli | 198/740 |
| 5,375,827 | 12/1994 | Lentz et al. | 271/271 |

FOREIGN PATENT DOCUMENTS

| | | | |
|---|---|---|---|
| 2220902 | 1/1990 | United Kingdom | 198/360 |

*Primary Examiner*—H. Grant Skaggs
*Attorney, Agent, or Firm*—Notaro & Michalos P.C.

[57] ABSTRACT

An apparatus for loading envelopes onto switching machines, characterized in that there are provided:

a sliding plane with a lower support rim on which said envelopes rest;

a plurality of pusher members arranged in successions, said pusher members being suited to successively engage said envelopes and cause each of them to advance towards the following pusher;

means suited to remove said lower support rim when the envelope passes in correspondence with the area for the introduction into the machine so as to allow the envelope to fall onto the switching machine.

1 Claim, 3 Drawing Sheets

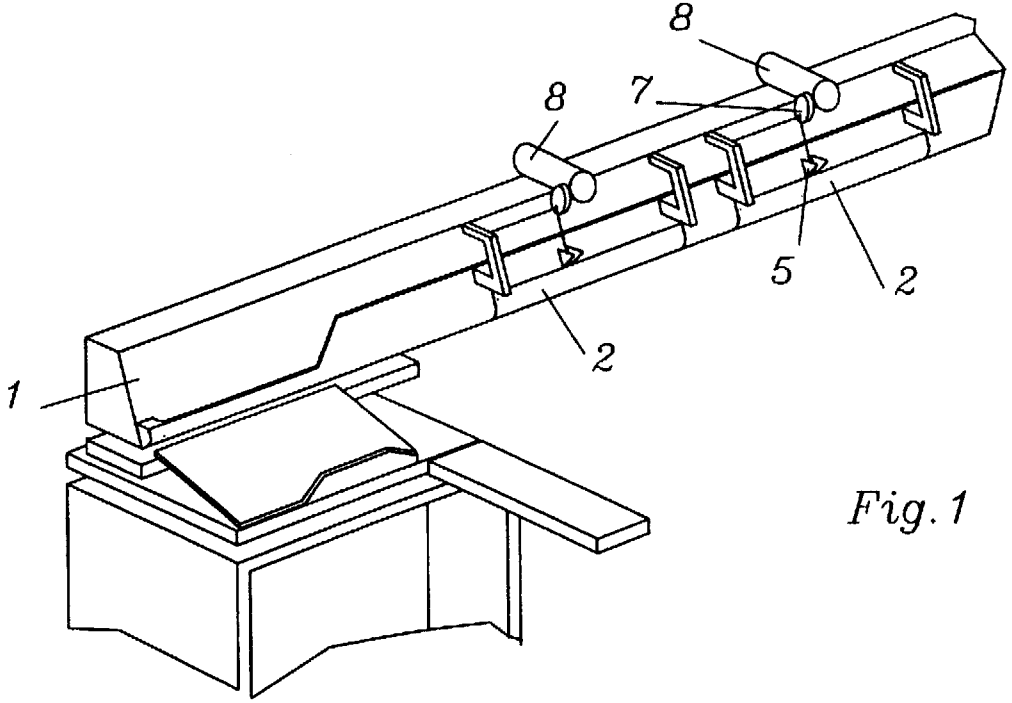
Fig. 1
Fig. 2
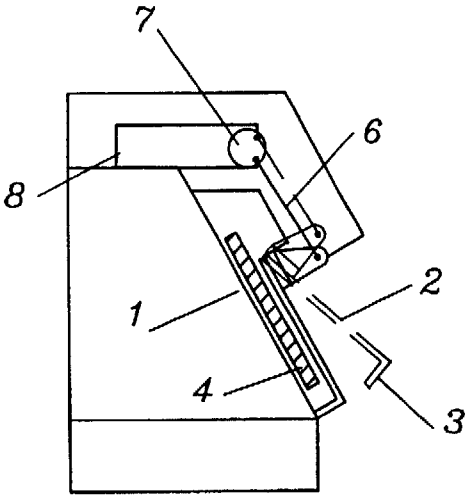

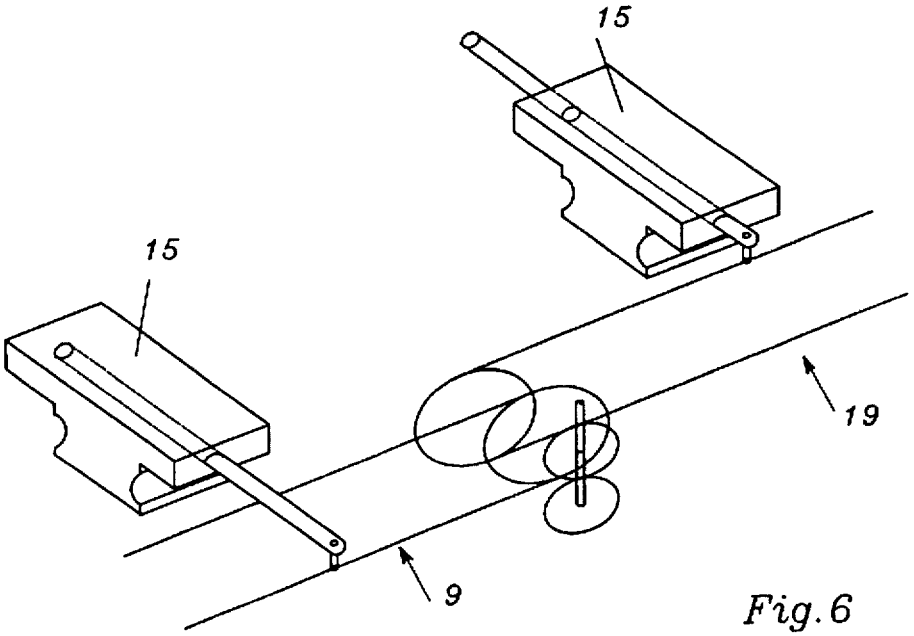
Fig. 6
Fig. 7
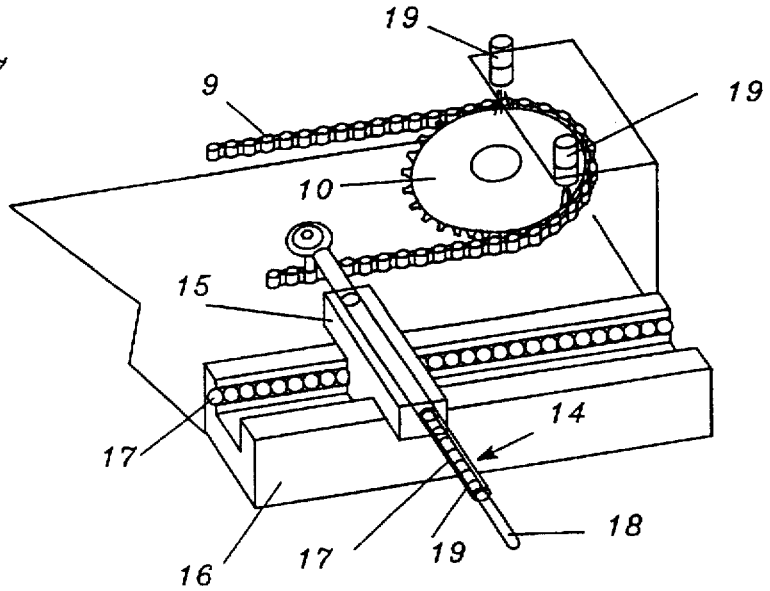

APPARATUS FOR LOADING ENVELOPES ONTO SORTING MACHINES

The present invention proposes an apparatus for loading objects, especially envelopes and the like, onto sorting machines, for example machines comprising a plurality of dollies each comprising an object transportation plane, each of said dollies receiving an envelope and discharging it into collection devices that can be preselected at the time of loading and are arranged along the path of the dollies.

The present invention relates to the field of distribution, in which a large number of objects are to be selected and sorted, thereby addressing each of them to pre-set collection devices.

An example can be taken from the publishing sector where the printed matter is to be directed towards the various distribution channels, or from the post offices or from the large mail sales organisation where many articles, each having an assigned code corresponding to a final destination, are input into an apparatus that switches and discharges them automatically into containers, said containers being each intended for a different destination.

Said sorting apparatuses can exhibit various configurations, even though the most frequently used ones consist of a plant comprising a plurality of dollies each provided with a plane for the transportation of the object, said plane possibly consisting of a tiltable pan or a rotating mat, said dollies moving along a fixed path to the side of which the collection devices are arranged.

Suitable control means of either a mechanical or an electronic type control the object discharge when the dolly passes in correspondence with the discharge area it has been assigned at the time the objects were input into the machine.

The apparatus according to the invention is intended for use together these sorting machines for loading, that is introducing into the machine, said objects, especially envelopes and the like.

Plants for the introduction of objects into the sorting apparatuses are known consisting an array of rotating mats, are arranged head by head, onto which the object is laid, said mats being actuated to send the object towards the sorting machine when an available doily passes in correspondence with these loading devices.

In order to precisely control the movement of the objects, these known systems require, however, highly sophisticated electronic circuitry, which heavily adds to the costs of the apparatus.

This problem is solved by means of the loading apparatus according to the invention.

The apparatus according to the invention comprises a plane along which said envelopes glide, said plane consisting of an inclined wall with a plurality of envelope support members, said support members each consisting of a door that can be opened in order to allow the object to fall towards an underlying container.

In correspondence with this path, dragging devices are arranged, said dragging devices consisting of a set of chains each mounted on a pair of sprocket wheels, a pin being fixed to each of said sprocket wheels, said pin sliding within a slider which in turn is slidably arranged in a guide that is parallel to the advancement direction of the envelopes.

During a length of the chain path, the pin protrudes relative to the sliding plane, thereby engaging the envelopes that are pushed forward, whilst in the return path the pin is completely retracted relative to said gliding plane.

Along the path a set of these devices are arranged, said devices being so synchronised that when a pin begins the return stroke the next one engages the envelope and pushes it forward for one more partial length, until the envelope reaches the discharge area and is caused to fall down by opening the door that forms the bottom wall of the path.

The apparatus will know be described in detail in an exemplary, non-limiting way, with reference to the enclosed drawings, in which:

FIG. 1 is a fragmentary perspective view of an introduction apparatus according to the invention;

FIG. 2 is a side view of the apparatus of FIG. 1;

FIG. 6 shows a detail of the devices of FIG. 3;

FIG. 7 is another detail of the envelope pushing devices, in a perspective view.

Figure 5:
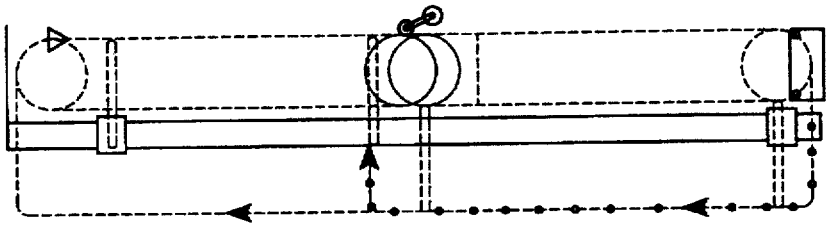
FIGS. 4 and 5 are the front and top view of the devices of FIG. 3, respectively.

With reference to FIG. 1, numeral 1 designates a chute consisting of an inclined wall onto which the envelopes are laid for introduction into the sorting machine.

This chute forms the gliding plane on which the envelopes move and a plurality of walls 2 are hinged to it with the lower part 3 bent towards wall 1 (FIG. 2), so as to withhold the envelopes 4, as clearly shown in FIG. 2.

The swinging wall 2 is mounted at a certain distance from the gliding plane 1 and is solidly connected to an arm 5 to which a rod 6 is hinged, said rod 6 being connected, at the opposite end, to a cam 7 that is driven by a motor 8 or the like.

Motor 8, through rod 6, drives the rotation of wall 2 around the hinge for lifting the wall, thereby allowing envelope 4 to fall into the sorting machine.

Plane 1 has a suitable length in accordance to the number of objects to be sorted and is provided with a plurality of doors 2, said doors being possibly lifted so as to allow the discharge operation to be carried out in several places, even contemporarily.

Electronic control means for handling all of the functions of the machine are provided, said means not being described because they are of a kind known in this field.

Figure 3:
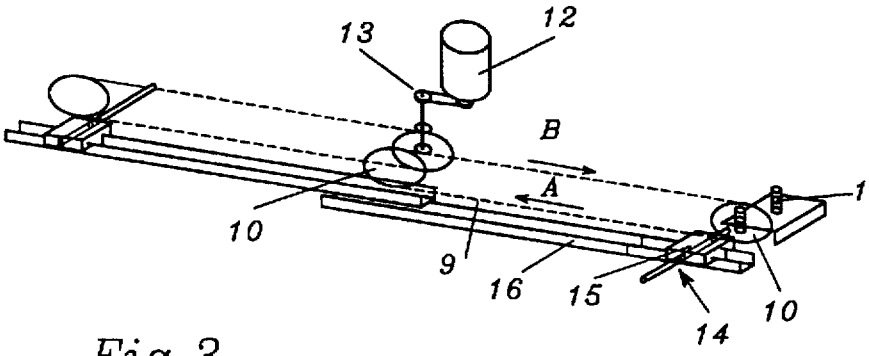
FIG. 3 is a fragmentary perspective view of the devices controlling the advancement of the envelopes towards the sorting machine.

The devices transporting the envelopes to the various doors are illustrated from FIG. 3 on.

These devices comprises several conveyor or pusher units that are arranged in succession, each of said units having essentially the same length as one door 2.

Figure 4:
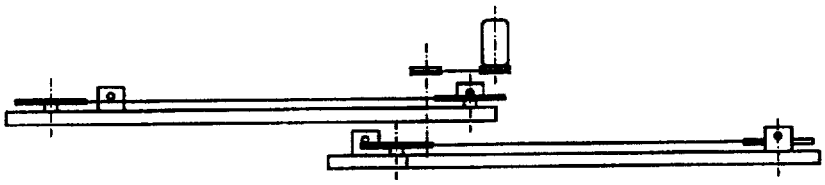

Two of said transportation devices are illustrated in FIGS. 3 to 5.

Each of them comprises a chain 9 that is mounted on a pair of wheels 10 and 11 with vertically oriented axes, said chains being driven by a motor 12 through a transmission device 13 of a known type.

To each chain 9 the end of a pin is hinged, said pin being indicated as a whole with 14 and being adapted to slide, in an orthogonal direction to chain 9, within a slider 15 which in turn can slide within a guide 19, in a parallel direction to the one of the chain, within a guide 16.

Guide 16 is arranged in a retracted position relative to plane 1, so that only pin 14 protrudes from this, and only in correspondence with a part of the path, as will be clear from the following description.

A possible embodiment of these devices is shown in detail in FIGS. 6 and 7 in which numeral 17 designates a plurality of spheres that are arranged in guides 16 to ease the gliding of slider 15.

Pin 14 essentially consists of a bush 17 that can freely slide within guide 15 and of a finger 18 that is mounted inside said bush and can glide relative to it in contrast to the force of a spring 19 biasing the finger outwards.

As already said, the pin 14 is secured at an end to chain 9 and moves with it, thereby dragging the slider 15 along a guide 16.

Along a first part of the path (:FIG. 3, right) the pin 14 protrudes relative to slider 15 and, consequently, relative to plane 1.

In this position, the pin 14 engages therefore the side of envelope 4 resting on plane 1, thereby dragging and pushing it to the next transportation device.

This first partial length of the path is indicated by arrow A in FIG. 3.

When the slider 15, on the contrary, runs on the return path, as shown also in FIG. 3 by arrow B, the pin 14, which is constrained to the chain, is retracted relative to slider 15 for a length corresponding to the diameter of wheels 10. During this phase pin 14 no longer protrudes relative to the chute 1, thereby allowing slider 15 to return to the starting position, the envelope being disengaged from pin 14.

The various pushers, arranged in succession, are operated in synchronism, so that when the pin 14 of one of them reaches the end of its stroke and retracts the pin of the following conveyor is protruded, thereby engaging in turn the envelope to push it on one step further to the next conveyor.

In this way the envelopes resting on wall 1 are successively engaged by the pins of the various transportation devices and pushed on each time with a pitch corresponding to the length of doors 2.

When each envelope is in correspondence with the selected loading area, the control devices of the machine cause the door 2 to be opened and the envelope slips onto the underlying sorting machine.

A pair of sensors 19 that are arranged for example near one of the support wheels 10 of the chain generates a set of signals upon the passage of each chain link, said signals being used by the computer controlling the machine to check the apparatus for smooth operation and obtain the information of the precise instant position of each pusher.

As can be seen from FIG. 5 where letter P is used to designate the path of pusher 14, the adjacent chains 9 are partly superposed so that the path of each pusher is superposed for a short length to the path of the following one, thereby assuring that when an envelope is abandoned it is already in a position where it can be engaged by the following pusher.

From the provided description also the operation of the system will clearly appear, means for engaging each envelope by means of a pusher member being provided, said pusher member causing the envelope to advance one step to bring it in correspondence with an area where it is engaged by a second pusher member that advances it a further step and so on, until it comes in correspondence with the discharge area where door 2 is caused to open, thereby allowing the envelope to fall into the underlying sorting machine.

A skilled artisan can devise many changes and variations that are all within the present invention.

We claim:

1. An apparatus for loading envelopes onto sorting machines, comprising:

a sliding plane with a lower support rim on which said envelopes rest;

a plurality of pusher members arranged in succession, said pusher members being suited to successively engage said envelopes and cause each of them to advance towards the following pusher, said pusher members each comprising a pin having an end secured to a chain that is mounted on a pair of sprocket wheels, said pin being slidably mounted within a slider which slidably moves within a guide, the guide being parallel to the sliding plane and oriented according to the advancing direction of the envelopes;

means suited to remove said lower support rim when the envelope passes in correspondence with the area for the introduction into the machine so as to allow the envelope to fall onto the sorting machine.

* * * * *